United States Patent [19]

Watson et al.

[11] Patent Number: 4,869,953

[45] Date of Patent: Sep. 26, 1989

[54] FLAME-RESISTANT MICROPOROUS COATINGS

[75] Inventors: Thomas F. Watson, Greensboro; Donald R. Towery, deceased, late of Pleasant Garden, both of N.C., by Barbara W. Towery, legal representative

[73] Assignee: Burlington Industries, Inc., Greensboro, N.C.

[21] Appl. No.: 239,019

[22] Filed: Aug. 30, 1988

Related U.S. Application Data

[63] Continuation of Ser. No. 143,527, Jan. 13, 1988, abandoned, which is a continuation-in-part of Ser. No. 903,130, Sep. 3, 1986, Pat. No. 4,707,400, which is a continuation-in-part of Ser. No. 2,278, Sep. 3, 1987, abandoned.

[51] Int. Cl.[4] ..... B32B 7/00

[52] U.S. Cl. ..... 428/260; 427/246; 428/254; 428/265; 428/290; 428/315.5; 428/423.1; 428/913; 428/920; 428/921

[58] Field of Search ..... 427/246; 428/260, 290, 428/315.5, 913, 920, 921, 423.1, 254, 265

[56] References Cited

U.S. PATENT DOCUMENTS

| | | | |
|---|---|---|---|
| 3,968,292 | 7/1976 | Pearman | 428/213 |
| 4,029,534 | 6/1977 | Bocko et al. | 156/246 |
| 4,282,285 | 8/1981 | Mohudden | 428/315.5 |
| 4,429,000 | 1/1984 | Naka et al. | 428/265 |
| 4,504,541 | 3/1985 | Yasuda et al. | 428/264 |
| 4,507,413 | 3/1985 | Thoma et al. | 524/42 |
| 4,554,198 | 11/1985 | Von Blücher | 428/143 |

FOREIGN PATENT DOCUMENTS 0762179 3/1971 France .

*Primary Examiner*—James J. Bell
*Attorney, Agent, or Firm*—Nixon & Vanderhye

[57] ABSTRACT

Water-vapor-permeable yet waterproof coated fabrics are prepared by applying a polyurethane resin solvent solution plus flame retardant to a base fabric then immersing the coating to coagulate the resin leaving a thin, microporous coating on the fabric. An acrylic acid thickener system may be included in the resin solvent solution. The resultant microporous coated fabric has a moisture vapor transmission rate of at least 600 g/m$^2$/24 hours, a hydrostatic pressure resistance of at least 69 kPa and is resistant to flame.

8 Claims, No Drawings

FLAME-RESISTANT MICROPOROUS COATINGS

This application is a continuation of earlier application Ser. No. 07/143,527 filed Jan. 13, 1988, now abandoned, which, in turn, is a continuation-in-part of earlier application Ser. No. 903,130 filed Sept. 3, 1986, now U.S. Pat. No. 4,707400 and International Application No. PCT/US87/02278 filed Sept. 3, 1987.

BACKGROUND OF THE INVENTION

1. Technical Field

This invention relates to an improved resin-containing coating solution which, when applied to a fabric substrate and processed to coagulate the resin, results in an improved waterproof, microporous, moisture-vapor-permeable, flame-resistant fabric. The coated fabric retains good moisture permeability with durable flame resistance that remains characteristic of the fabric even following multiple launderings. Procedures for making such fabrics are also described.

2. Background

Coated fabrics suitable for use as activewear, rainwear and tentage function by blocking the pores of a woven, knitted or non-woven fabric with a cohesive polymer film which acts as a physical barrier against wind, water, and in the case of protective workwear, aggressive chemicals, oils, and greases. This barrier or coating distinguishes polymer coatings from chemical finishes which merely coat the individual fibers of a fabric without blocking the pores, and repel fluids by surface tension effects. Microporous coated fabrics repel water from the outside yet allow perspiration and moisture vapor to escape from the inside. Moisture is transmitted through a tortuous physical pathway produced in the cellular film or coating resulting from the art-recognized wet coagulation process, as described in more detail below. Polymeric coatings have initially been based upon rubber or synthetic or fluorocarbon rubbers, and more recently, polyurethanes, acrylics, silicone elastomers and polyvinylchlorides.

Fashion and leisurewear, particularly rainwear, require that the coated material be attractive with good drape and handle, that it be water repellent, although not necessarily for prolonged use in heavy rain, and that the fabric retain these properties after drycleaning or laundering.

There are several fabrics available that satisfy the conflicting requirements of waterproofness and breathability. One example is Entrant, which is a woven nylon fabric coated with a microporous polyurethane film formed by the so-called wet coagulation technique as described in U.S. Patent 4,429,000 to Toray Industries, Inc. Other polyurethane coated fabrics are described in U.S. Patent 3,360,394 to Griffin. In the wet coagulation method, a thin, microporous polyurethane layer is formed on a base fabric by applying a coating solution of a polyurethane dissolved in a polar organic solvent that will solubilize the polyurethane yet is miscible with water. The polymer solution is applied to the fabric substrate by knife coating or the like, then immersed in a bath of water which selectively dissolves or mixes with the organic solvent, exchanges water for the polar solvent and causes the previously dissolved polyurethane to coagulate, leaving a thin, microporous coating having a cellular substrate on the fabric. Surface pores that result are generally one micron or less in diameter. Such pores are small enough to exclude water droplets and yet they provide a tortuous physical pathway from the base fabric to the coating surface, to allow water vapor to pass through the fabric. The coating is a thin polymeric (polyurethane) film.

Typical coating solutions contain a resin, usually a polyurethane elastomer, optionally a water repellent agent, a thickener, a surfactant and possibly other adjuvants, all dissolved in a water-miscible polar organic solvent such as dimethylformamide, N-methyl-2-pyrrolidone, dimethylacetamide or dimethylsulfoxide. The coagulating bath contains water with up to 20% by weight of the same or a compatible polar solvent. Coating viscosity must be carefully controlled to adjust penetration and interstitial strike-through, especially on loosely-woven and textured fabrics.

In addition to apparel uses, microporous coated fabrics are used for tentage and tarpaulins. Both uses demand waterproofness as a primary requirement. For both a high water vapor transmission rate is very desirable, in order to prevent the accumulation of condensed moisture on the inner surface of the structure. Flame resistance, particularly in tents for both military and civilian use, is extremely important for articles constructed of microporous coated fabrics. As with the other components mentioned above, the flame-resistant coating must be durable to cleaning, usually laundering in water. Flame-resistant microporous coated fabrics are included within this invention.

Microporous coatings, as described above and elsewhere, are made by dissolving a polymer in a water-miscible solvent, then mechanically applying this solvent solution as a coating to a fabric. The thus-coated fabric is then immersed in a non-solvent, such as water. The microporous structure of the coating is completed when all the solvent has been displaced with the non-solvent, leaving a microporous layer on the base fabric.

DISCLOSURE OF THE INVENTION

Disclosed is a process for preparing a flame-resistant, waterproof, water-vapor-permeable coated fabric that exhibits enhanced flame resistance while at the same time exhibiting good hydrostatic pressure resistance, formed in a rapid and reproducible manner by coagulation from a solvent solution of a polyurethane elastomer containing a flame retardant. The fabric is coated using the wet coagulation method in which a polymeric elastomer or mixture of polymeric elastomers is dissolved in a water-miscible polar organic solvent. The polymer solution, to which a flame-retarding amount of an effective flame retardant is added, is coated onto a base fabric and then immersed in a coagulation water bath. The water extracts the polar organic solvent, which is itself water-miscible, from the coating, leaving a porous, spongy polyurethane matrix having the specified porosity and other properties with the flame retardant on the base fabric. Washing to remove any unextracted polar organic solvent and drying follow.

A convenient thickener system is based on acrylic acid polymers that are compatible with the solvent-polyurethane system and soluble in the solvent, is used to control and adjust coating solution viscosity which, in turn, leads to thin, flexible polyurethane elastomer coatings having the optimum performance and customer acceptance properties. Such thickener systems are disclosed in earlier, commonly assigned application Ser. No. 903,130 filed Sept. 3, 1986, now U.S. Pat. No. 4,707,400, the disclosure of which is hereby incorporated by reference. The coating composition preferably also includes at least one surfactant to control the rate at which water exchanges with dimethylformamide in the wet coagulation process which, in turn, affects the pore size of the urethane foam.

The base fabric may be woven, knit or nonwoven. Filament polyester was used in the examples that follow; however, nylon and polyester/cotton or nylon/-cotton blends of various constructions may be used.

Typical urethane-based, water-coagulable coating compositions are as follows:

| | | |
|---|---|---|
| Urethane resin(s) | Up to | 48% |
| Nonionic surfactant(s) | Up to | 8% |
| Water | Up to | 6% |
| Acrylic acid thickener | Up to | 1% |
| Amine | Up to | 0.15% |
| Flame retardant | Up to | 15% |
| Water-miscible polar organic solvent | | Balance |

It will be understood that the coating composition may contain coating additives and adjuvants, such as a pigment or colorant, water repellent, antistat, etc.

The quantities of each of these ingredients may be varied depending upon the result desired, for instance depending on the coating viscosity and total solids requirements. Each of the above-listed ingredients must be present in the minimum amount indicated or, if an optional ingredient, must be present in an amount of at least 0.1%. All parts and percentages herein are expressed by weight unless otherwise indicated. The minimum viscosity of the coating material, when applied to the base fabric is 0.5 Pa s.

Performance requirements for urethane-coated fabrics will vary depending upon the application or end use to which the fabric is exposed. As a point of reference, and without particular limitation, a typical urethane-coated nylon taffeta for use in constructing sportswear will have the following minimum values:

| | |
|---|---|
| Moisture vapor transmission rate ($g/m^2$/24 hours) | 600 |
| Hydrostatic pressure resistance | 69 kPa |

The flame retardant, upon coagulation, becomes entrapped in the cellular matrix of the microporous coating, is resistant to removal or solubilization by water and remains in the coating in quantities effective for the intended purpose even following multiple launderings.

The coating formulations are prepared as follows: the urethane resin or mixture of resins are preweighed into a container. Water, the polar organic solvent, usually DMF, the surfactant, and the flame retardant(s) are preweighed into a separate container and mixed thoroughly. Other components of the type described above may be included. The water/solvent mixture is then added to the urethane under agitation. The optimum procedure for mixing of ingredients and order of mixing will be determined through a brief series of small-scale experiments, care being taken to avoid premature coagulation of the coating solution.

Once the coating solution is prepared, the urethane coating is applied to any textile substrate capable of supporting the liquid film by any conventional coating method appropriate for use in the wet coagulation method. The coated fabric is then dipped in a coagulation bath consisting of water, or water and an additive to alter or adjust coagulation, e.g., DMF, a surfactant, etc. During the coagulation step, the majority of DMF in the DMF/urethane film migrates into the coagulation bath and is replaced by water, generating a coherent, tenacious, microporous, spongy film on the fabric surface. After additional washing to remove any remaining DMF, the fabric is dried and optionally given a water repellent finish.

Performance Characteristics and Evaluations

The following examples evaluate various coated fabrics as to moisture vapor transmission rate (MVTR) measured according to ASTM E96-80, Procedure A and Mullen Hydrostatic Resistance (MH) measured according to ASTM D751-79. Flame resistance was measured by (U.S.) Federal Test Method Standard No. 191, Method 5903; and coating weight (CW) measured as grams of coating applied per square meter.

The materials used in the examples that follow are Texthane 420C, a one-component aromatic polyester solution containing 35% solids and 65% DMF by weight. Texthane 620C, also a one-component aromatic polyester, is supplied as a 30% solids solution in 70% DMF by weight. Texthane 620C makes a softer, more extensible film than does Texthane 420C. Both are supplied by Capros through Polymer Industries, a subsidiary of Morton Thiokol, Inc. Pluronic L35 (BASF Wyandotte Corporation, Parsippany, New Jersey), a surfactant, is a block copolymer of polyoxypropylene and polyoxymethlene, and is used to control the rate at which the water exchanges with DMF in the wet coagulation process, which in turn affects the pore size of the urethane foam.

Representative flame retardents used in the invention are:

- CD-75P (Great Lakes Chemical Co.) is industrial grade hexabromocyclododecane.
- DE-71 (Great Lakes Chemical Co.) is industrial grade pentabromodiphenyl oxide.
- FF-680 (Great Lakes Chemical Co.) is industrial grade bis(tribromophenoxy)ethane.
- Firemaster 836 (Great Lakes Chemical Co.) is a proprietary product containing 35–37% of Br, 8–9.5% of Cl, and 6–8% of phosphorus.
- Great Lakes B-MAP is a proprietary product consisting of a phosphorus/nitrogen polymer and a sugar to provide intumescent action.
- Kynar Solution, 22% in N-methylpyrollidone is a solution of Kynar 2900, a copolymer of vinylidene difluoride and hexafluoropropylene.

The invention will be further explained with reference to the following examples in which all parts and percentages are by weight unless otherwise indicated.

EXAMPLE I

A treating bath was prepared by mixing 23.5 parts of Texthane 420C, 29.5 parts of Texthane 620C, 4 parts of Pluronic L-35, 21 parts of dimethylformamide (DMF), 15 parts of hexabromocyclododecane, and 7 parts of antimony trioxide, all parts being by weight. All of the ingredients formed a homogeneous solution except for the antimony trioxide, which was in the form of a suspension.

The above-described bath was coated onto a 100% polyester filament fabric, made of 2-ply 300/54 DuPont 56T continuous filament textured yarn. The weight of the fabric before coating was 271 $g/m^2$. Coating was performed by a knife-over-roll method, after which the fabric passed into a bath containing 5% of DMF and 95% of water at 38° C. to permit coagulation and replacement of the DMF with water. The DMF was then completely washed out of the fabric, after which the fabric weighed 407 g/m$^2$, and contained 7.1% of bromine, based on the weight of the coated fabric. When tested according to Federal Test Method 5903, the fabric had an afterflame time of 3.6 seconds, a char length of 14 cm, and no melt drip. In contrast, an untreated control showed extensive melt drip and burned its entire length. The coated fabric had a moisture vapor transmission (MVT) greater than 3500 g/m$^2$/24 hours and a Mullen hydrostatic pressure resistance of more than 550 kPa.

EXAMPLES II–XIII

The following were conducted in the same manner as described above, using the same base fabric, the same method of application, and the same test methods, but different coating formulas. The results obtained are summarized in Table 1. None of the treated fabrics exhibited melt drip when tested according to Test Method 5903.

Coated fabrics having a thin, flame-resistant, microporous, aromatic urethane coating have a moisture-vapor transmission of at least 800 g/m$^2$/24 hours and a hydrostatic pressure resistance of at least 69 kPa and are significantly more resistant to flame than the corresponding untreated fabrics.

TABLE 1

Properties of Flame-Resistant, Microporous Fabric

| Example No. | Coating Formula | | Coated Fabric Weight oz/yd$^2$ | Br Content % | After-flame Time sec. | Char Length in. |
|---|---|---|---|---|---|---|
| II | Texthane 420C | 23.5 | 13.2 | 8.6 | 4.1 | 5.3 |
| | Texthane 620C | 29.5 | | | | |
| | Pluronic L-35 | 4.0 | | | | |
| | DMF | 17.0 | | | | |
| | Great Lakes CD-75P | 18.0 | | | | |
| | Antimony trioxide | 8.0 | | | | |
| III | Texthane 420C | 23.5 | 12.0 | 3.1 | 0 | 3.4 |
| | Texthane 620C | 29.5 | | | | |
| | Pluronic L-35 | 4.0 | | | | |
| | DMF | 34.5 | | | | |
| | Firemaster 836 | 8.5 | | | | |
| IV | Texthane 420C | 23.5 | 13.1 | 3.4 | 14.5 | 5.1 |
| | Texthane 620C | 29.5 | | | | |
| | Pluronic L-35 | 4.0 | | | | |
| | DMF | 31.0 | | | | |
| | Firemaster 836 | 8.5 | | | | |
| | Great Lakes B-MAP | 3.5 | | | | |
| V | Texthane 420C | 23.5 | 13.3 | 3.3 | 8.3 | 5.6 |
| | Texthane 620C | 29.5 | | | | |
| | Pluronic L-35 | 4.0 | | | | |
| | DMF | 28.0 | | | | |
| | Firemaster 836 | 8.5 | | | | |
| | Great Lakes B-MAP | 6.5 | | | | |
| VI | Texthane 420C | 24.5 | 10.8 | 6.4 | 10.0 | 5.5 |
| | Texthane 620C | 28.5 | | | | |
| | Pluronic L-35 | 4.0 | | | | |
| | DMF | 26.5 | | | | |
| | Great Lakes CD-75P | 11.5 | | | | |
| | Antimony trioxide | 5.0 | | | | |
| VII | Texthane 420C | 24.5 | 13.5 | 8.2 | 3.7 | 4.5 |
| | Texthane 620C | 28.5 | | | | |
| | Pluronic L-35 | 4.0 | | | | |
| | DMF | 48.0 | | | | |
| | Great Lakes CD-75P | 23.0 | | | | |
| | Antimony trioxide | 10.0 | | | | |
| | 22% Kynar Soln. | 5.0 | | | | |
| VIII | Texthane 420C | 24.3 | 13.2 | 7.9 | 1.5 | 4.4 |
| | Texthane 620C | 28.3 | | | | |
| | Pluronic L-35 | 4.0 | | | | |
| | DMF | 11.4 | | | | |
| | Great Lakes CD-75P | 12.0 | | | | |
| | Antimony trioxide | 20.0 | | | | |
| IX | Texthane 420C | 23.5 | 12.0 | 4.6 | 2.0 | 5.8 |
| | Texthane 620C | 29.5 | | | | |
| | Pluronic L-35 | 4.0 | | | | |
| | DMF | 18.5 | | | | |
| | Great Lakes FF-680 | 24.5 | | | | |
| | Antimony pentoxide | 11.5 | | | | |
| X | Texthane 420C | 24.5 | 13.5 | 9.4 | 2.4 | 4.9 |
| | Texthane 620C | 28.5 | | | | |
| | Pluronic L-35 | 4.0 | | | | |
| | DMF | 7.0 | | | | |
| | Great Lakes CD-75P | 12.0 | | | | |
| | Antimony pentoxide | 24.0 | | | | |
| XI | Texthane 420C | 24.5 | 15.4 | 4.6 | 3.5 | 3.3 |
| | Texthane 620C | 28.5 | | | | |
| | Pluronic L-35 | 4.0 | | | | |
| | DMF | 7.0 | | | | |

TABLE 1-continued

| Example No. | Coating Formula | | Properties of Flame-Resistant, Microporous Fabric: Coated Fabric Weight oz/yd$^2$ | Br Content % | After-flame Time sec. | Char Length in. |
|---|---|---|---|---|---|---|
| | Great Lakes CD-75P | 12.0 | | | | |
| | Antimony trioxide | 24.0 | | | | |
| XII | Texthane 420C | 24.5 | 15.2 | 4.2 | 0 | 4.1 |
| | Texthane 620C | 28.5 | | | | |
| | Pluronic L-35 | 4.0 | | | | |
| | DMF | 11.0 | | | | |
| | Great Lakes CD-75P | 12.0 | | | | |
| | Antimony trioxide | 20.0 | | | | |
| XIII | Texthane 420C | 24.5 | 13.3 | 8.4 | 3.8 | 4.6 |
| | Texthane 620C | 28.5 | | | | |
| | Pluronic L-35 | 4.0 | | | | |
| | DMF | 21.0 | | | | |
| | Great Lakes CD-75P | 15.0 | | | | |
| | Antimony trioxide | 7.0 | | | | |

What is claimed:

1. A process of preparing a flame retardant waterproof, water-vapor-permeable, coated fabric having a microporous polyurethane layer thereon formed by the wet coagulation method, said process comprising the steps of:

(a) applying to the base fabric a water-miscible, polar organic solvent coating solution of an aromatic polyurethane elastomer dissolved in the polar organic solvent, (b) immersing the thus-coated base fabric into an aqueous coagulation bath to extract the solvent from the polymer solution causing the previously dissolved polyurethane elastomer to coagulate on the base fabric leaving a porous aromatic polyurethane matrix formed directly on and adhered to the base fabric, then (c) washing and drying the coated fabric, wherein the polyurethane elastomer solution contains a flame-retarding amount of a flame retardant and the resulting microporous layer has the flame retardant imparted therein and has surface pores therein of one micron or less.

2. The process of claim 1, in which the coated fabric has a bromine content of at least 3% based upon the weight of the coated fabric.

3. The process of claim 1, in which the flame retardant is hexabromocyclododecane
pentabromodiphenyl oxide
bis(tribromophenoxy)ethane, or
a copolymer of vinylidene difluoride and hexafluoropropylene.

4. The process of claim 3, in which the flame retardant is a mixture of antimony oxide and hexabromocyclododecane.

5. The process of claim 1, in which the resulting flame-resistant, water-roof, water-vapor-permeable, coated fabric has a moisture vapor transmission rate of at least 600 g/m$^2$/24 hours, a hydrostatic pressure resistance of at least 69 kPa and a bromine content of at least 3% based upon the weight of the coated fabric.

6. A process of preparing a flame retardant, waterproof, water-vapor-permeable, coated fabric having a microporous polyurethane layer thereon formed by the wet coagulation method, said process comprising the steps of:

(a) applying to a base fabric a water-miscible, polar organic solvent coating solution of an aromatic polyurethane elastomer dissolved in the polar organic solvent and a bromine-containing flame retardant, (b) immersing the thus-coated base fabric into an aqueous coagulation bath to extract the solvent from the polymer solution causing the previously dissolved polyurethane elastomer to coagulate on the base fabric leaving a porous aromatic polyurethane matrix with the bromine-containing flame retardant therein formed directly on and adhered to the base fabric, then (c) washing and drying the coated fabric, so that the resulting flame-resistant, waterproof, water-vapor-permeable, coated fabric has a moisture vapor transmission rate of least 600g/m$^2$/24 hours, a hydrostatic pressure resistance of at least 69 kPa and a bromine content of at least 3% based upon the weight of the coated fabric.

7. The process of claim 6, in which the coated fabric has a microporous layer with surface pores therein of at most one micron in diameter.

8. A flame-resistant, waterproof, water-vapor-permeable, coated fabric having micropores therein of at most one micron in diameter, a moisture vapor transmission rate of at least 600 g/m$^2$/24 hours, a hydrostatic pressure resistance of at least 69 kPa, and a bromine content of at least 3% based on the weight of the fabric, and a mixture of antimony oxide plus hexabromocyclododecane as the flame retardant.

* * * * *